United States Patent [19]

Segraves et al.

[11] 4,069,363

[45] Jan. 17, 1978

[54] CRIMPABLE NYLON BICOMPONENT FILAMENT AND FABRICS MADE THEREFROM

[75] Inventors: William Benjamin Segraves, Martinsville, Va.; Kenneth Lee Mulholland, Hockessin, Del.

[73] Assignee: E. I. Du Pont de Nemours and Company, Wilmington, Del.

[21] Appl. No.: 702,446

[22] Filed: July 6, 1976

Related U.S. Application Data

[63] Continuation of Ser. No. 581,158, May 27, 1975, abandoned, which is a continuation-in-part of Ser. No. 493,393, July 31, 1974, abandoned.

[51] Int. Cl.[2] ..... D02G 3/00; D04B 11/00; D04H 1/00

[52] U.S. Cl. ..... 428/224; 66/178 A; 66/202; 428/253; 428/359; 428/362; 428/370; 428/374; 428/397

[58] Field of Search ..... 428/224, 374, 370, 369, 428/371, 395, 397, 152, 253, 359, 362; 57/140 R, 140 BY; 66/178, 202; 264/168

[56] References Cited

U.S. PATENT DOCUMENTS

| | | | |
|---|---|---|---|
| 3,399,108 | 8/1968 | Olson | 428/229 |
| 3,418,199 | 12/1968 | Anton et al. | 428/374 |
| 3,526,571 | 9/1970 | Ogata | 428/373 |
| 3,574,047 | 4/1971 | Ando et al. | 428/374 |
| 3,667,207 | 6/1972 | Ben et al. | 264/171 X |
| 3,779,853 | 12/1973 | Olson | 264/168 X |

*Primary Examiner*—Lorraine T. Kendell

[57] ABSTRACT

A crimpable, nylon bicomponent filament having a sheath of a selected polyamide on an eccentric core of a random copolymer of hexamethylene dodecanedioamide and ϵ-caproamide units. The copolymer contains about 25–45% by weight of ϵ-caproamide units.

12 Claims, 2 Drawing Figures

CRIMPABLE NYLON BICOMPONENT FILAMENT AND FABRICS MADE THEREFROM

CROSS REFERENCE TO RELATED APPLICATION

This application is a continuation of copending application Ser. No. 581,158 filed May 27, 1975 now abandoned; which is in turn a continuation-in-part of copending application Ser. No. 493,393, filed July 31, 1974, now abandoned.

BACKGROUND OF THE INVENTION

This invention relates to yarns melt spun from synthetic, linear polyamides and, more particularly, to composite filaments.

Nylon filaments and yarns have long been predominant in the women's hosiery market. In recent years, there has been a strong demand for so-called stretch hose which are much smaller than the legs on which they are to be worn but stretch sufficiently to provide not only improved fit but also a reduction in the number of sizes required for the normal range of leg sizes.

Crimpable filaments particularly suitable for stretch hosiery have been disclosed by Olson in U.S. Pat. No. 3,399,108. Such filaments are able to crimp against tensions and restraints imposed by the stitches in a knit fabric, thus conferring excellent stretchability on hosiery prepared from such a fabric. Although filaments of the compositions disclosed by Olson produce hosiery of high quality, a need for further improvements in the performance and appearance of today's stretch fabrics has been recognized.

SUMMARY OF THE INVENTION

Improvements in durability, fit and fit retention have now been achieved in hosiery knit from a crimpable yarn of at least one nylon filament having two continuous, adherent, eccentric components, one component being a sheath consisting essentially of a homopolymer selected from the group consisting of polyhexamethylene dodecanedioamide, polyhexamethylene adipamide and poly-ϵ-caproamide, the other component being a core consisting essentially of a random copolymer of hexamethylene dodecanedioamide and ϵ-caproamide units. The copolymer contains about 25—45% by weight of ϵ-caproamide units.

DESCRIPTION OF THE PREFERRED EMBODIMENTS

Figure 1:
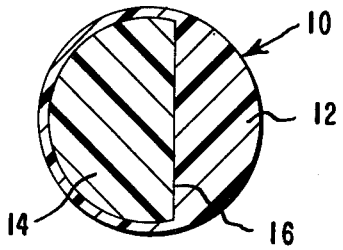
FIG. 1 is an enlarged cross section of the composite filament of the present invention and FIG. 2 is a vertical, sectional view of a spinneret suitable for its production.

In each filament 10, a continuous sheath 12 of a selected polyamide surrounds an eccentric core 14. An edge 16 of core 14 adjacent the thick portion of sheath 12 is substantially flat. The core is a copolymer of hexamethylene dodecanedioamide (6–12 nylon ) and E-caproamide (6 nylon) units which contains about 25–45% by weight of 6 nylon units (Example IV). Better properties are achieved at core contents of 30–40% by weight 6 nylon units. In this respect, filaments with cores containing about 35% by weight of 6 nylon units have a unique balance of properties, whereas filaments with cores containing 20% and 50%, respectively, by weight of 6 nylon units have been found unsuitable for present purposes (Examples IV. V and VII).

Illustrative preparations of 6–12 nylon homopolymer and 6–12/6 nylon copolymer are described in Example I.

Figure 2:
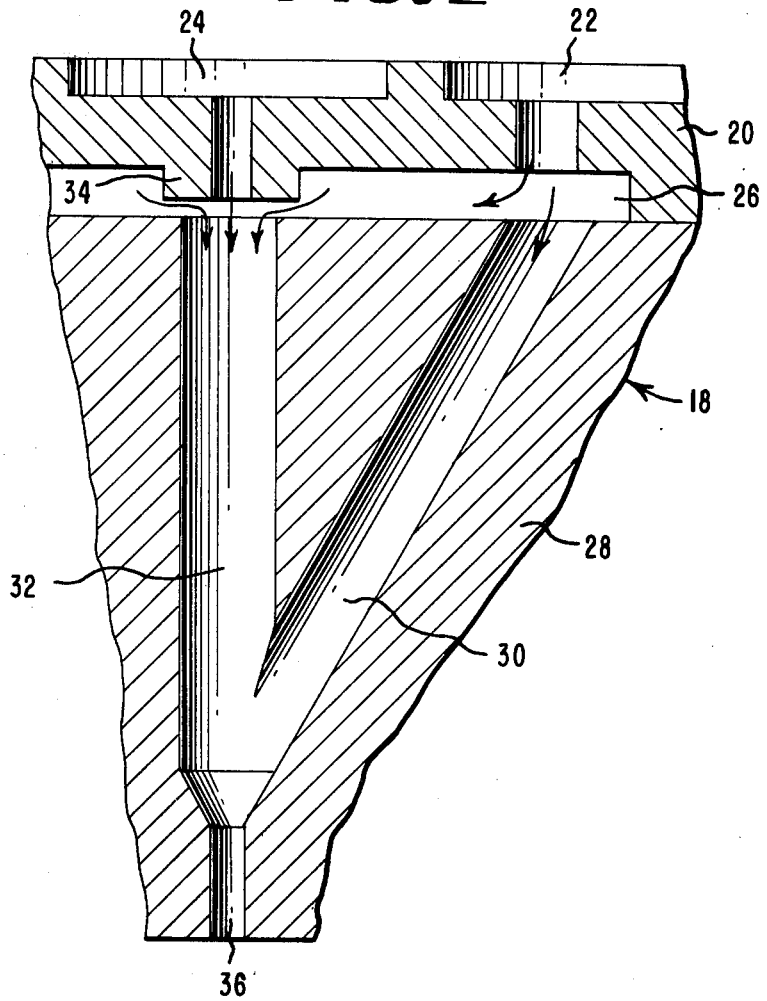

The test filaments 10 exemplified herein were prepared by melt spinning an extrudate of two continuous, eccentric components in a sheath-core relationship through a spinneret assembly 18 of the type shown in FIG. 2. Spinneret assembly 18 includes a distribution plate 20 having separate cavities 22, 24 from which the homopolymer and copolymer, respectively, are discharged under pressure to a distribution space 26 between plate 20 and a spinneret plate 28. The sheath polymer from cavity 22 passes through space 26 to passages 30, 32 as indicated by arrows. The core copolymer is discharged axially into passage 32, i.e., the two materials flow through passage 32 in substantially concentric paths. The diameter of a projection 34 and its spacing from plate 28 are chosen to provide a preselected ratio of homopolymer flow rates into passages 30, 32. At the juncture of passages 30, 32 the two flows are combined in a side-by-side relationship and a composite filament 20 is extruded through a reduced round spinning orifice 36. If trilobal or other filament cross sections are desired, passages 36 can be shaped accordingly. Additional orifices provided in spinneret plate 28 are supplied from cavities 22, 24 through distribution passages duplicating those shown in FIG. 2.

Sheath 12, along its thinnest arc adjacent the outer, convex surface of core 14, has a thickness of about 1% of the filament diameter. For a given spinning system, this dimension is dependent on the clearance between projection 34 and spinneret plate 28, typically of the order of 3–3.5 mils. (0.076–0.089 mm).

The magnitude of the difference in relative viscosities (ΔRV) between sheath and core polymers is important for obtaining optimum operability. When the filament is 50–60% by weight core and RV for each component is determined using the same solvent, the sheath polymer RV is preferably about 2 to 8 units less than that of the core polymer. Two methods for measuring RV are given under "Definitions and Test Descriptions"; and both can be used for measuring core polymer RV. If ΔRV is either too large or too small, bending of the extruded stream occurs at the spinneret face, and the D-shape of the core is undesirably distorted. Selection of ΔRV to eliminate bending of the extruded stream provides optimum operation.

On emergence from the spinneret, the filaments are quenched, separated into yarns of one or more filaments, and then either wound on an intermediate package before being drawn or advanced continuously to a draw zone. In some instances, the drawn yarn is heat set before packaging but the sensitive, precrimping step disclosed by Olson is eliminated. Detailed descriptions of several yarn preparations have been set forth in the examples.

Two types of yarn are used in knitting hose or pantyhose, i.e., welt yarns and leg yarns. Welt yarns are normally 40–50 denier yarns with 6 to 13 filaments. They are used to knit the panty portion and toes of pantyhose and the welt, shadow welt, and toes or regular hose. In the examples, the welt yarns used are commercially available stretch yarns of the false-twist-textured or bicomponent types. Only the legs of either type of garment are knitted from the yarns described in the following examples. The "heel mark" is simply a single end of another visible yarn knit in for a few stitiches of one course. When changing from an area knit or welt yarn to one knit of leg yarn, or vice versa, the two yarns are plied for a portion of one course to fasten the areas together.

In knitting hose, welt yarn is first fed to a knitting machine. After a welt portion is knitted, it is doubled and stitched on the machine to form the final welt before knitting a short undoubled portion known as the shadow welt. Then, leg yarn is fed in place of welt yarn for knitting the upper leg, transition, lower leg, ankle and foot portions. A switch back to welt yarn feed is made for finishing the toe.

Pantyhose are similarly prepared, except that each knit tube has a longer portion initially knit from welt yarn to provide half of a panty section. There is no doubling of the welt as in the hose described above. The heavier fabric at the top of a tube for pantyhose is then slit and seamed to finish the panty. All hose or pantyhose disclosed herein were circular-knitted in a plain jersey stitch throughout. Some were prepared using multiple-feed machines, but most were knit on single-feed machines.

The straight, uncrimped yarn of this invention handles well during knitting operations. The unexpectedly high shrinkage force of the copolymeric component makes possible the development of more than adequate crimp by shrinkage in fabric form. Heat treatment of the order of 100° C., as routinely used during customary fabric finishing, is sufficient to develop this crimp. Known crimpable filaments have not had sufficient differential shrinkage to develop adequate crimp for the first time against restraints present in fabrics. Accordingly, it has been necessary to precrimp bicomponent filaments with heat setting in order to substitute relatively stronger forces of heat-set, crystalline "memory" for weaker, shrinkage forces.

Hose knit from crimpable, nylon yarns of this invention are very durable because of their high yarn tenacity at break. Variable delays between drawing and crimping have no effect on the crimp properties obtained. Known crimped and crimpable yarns have been very sensitive to these variable delays, making it difficult to achieve uniform crimp properties, especially where the yarns are spun in one operation and then drawn and precrimped or otherwise textured in an entirely separate operation, with yarn-packaging therebetween.

Because of its unique balance of properties, there is no need to precrimp the yarns of this invention, i.e., the as-drawn yarn can be knit directly into a fabric. Surprisingly, the as-drawn yarn provides significantly better hosiery stretch and recovery properties than the same yarn precrimped (Table 2). In addition to high cost, a precrimping step sometimes causes periodic sections of low crimp in the yarn, presumably due to random filament-to-filament and filament-to-heater contacts while being crimped in a nearly tensionless state. These low-crimp zones appear as flaws in knit fabrics. The as-drawn, crimpable yarns of this invention are free from such low-crimp zones. Equally significant is the fact that, since the inherently slow precrimping step is eliminated, crimpable linear-polyamide bicomponent-filament yarns of this invention can be made readily in a single coupled process beginning with melting of the components and ending with packaging of yarn ready for knitting or weaving.

While the 6–12//6–12/6, 6–6//6–12/6 and 6//6–12/6 nylon yarns disclosed herein (6–6 nylon is polyhexamethylene adipamide; // separates sheath and core components and / separates polymer units in the copolymeric core) are especially well suited as hosiery leg yarns, their use is by no means so limited. For instance, welt yarns in customary deniers and counts are readily prepared. Multifilament yarns of usual textil deniers (e.g., 40–150 denier) are also suitable for the preparation of tricot or circular-knit fabrics for stretch apparel, e.g., swimsuits, men's slacks, sports clothing and the like. Also, the filaments of this invention may be cut to staple fibers (ordinarily from 3 to 18 denier per filament) and used alone or blended with other staple to prepare fabrics, which, on subsequent heat treatment, become bulky when the staple fibers of this invention shrink and crimp.

With the 6–12//6–12/6 nylon yarns disclosed herein, better levels of fabric sheerness can be achieved because of the manner in which dyes, under proper conditions, partition preponderantly to the 6–12/6 nylon cores. In this respect, it has been demonstrated that 6–12/6 nylon accepts acid dyes very readily. Similarly, disperse dyes sometimes favor the 6–12/6 nylon core, leaving the homopolymeric nylon sheath lighter in color.

DEFINITIONS AND TEST DESCRIPTIONS

1. Relative Viscosity.

Relative viscosity (RV) is the solution-to-solvent ratio of absolute viscosities at 25° ± 0.05° C. For the 6–12 polymers and copolymers and for the 6 nylon reported herein, a 6.166 percent by weight solution of the polymer in a 50% formic acid (98%), 50% phenol solvent is used. For polyhexamethylene adipamide (6–6 nylon) (Examples IV, V and VII), the solvent is 90% by weight formic acid (10% water) and the polymer solution has 8.4% by weight polymer in the solvent.

2. Tensile Properties.

These are calculated from measurements of a trace recorded on a stress-strain analyzer. Sample length is 10 inches (25.4 cm.) and elongation is at the rate of 6 in./-min. (15.2 cm./min.). Before testing, packaged yarn is conditioned for at least 24 hours in a 72% RH, 25° C. atmosphere. Tenacity (T) is the load in grams at the point of failure dividied by the denier of the packaged, conditioned yarn. Elongation (E) is the percent increase in length of the sample at the point of failure. Tenacity ($T_B$) is the load in grams at the point of failure divided by denier at the point of failure. It is computed from:

$$T_B = T(1+E/100).$$

3. Crimp Properties

A 750 denier bundle of yarn is prepared by winding the requisite number of turns on a reel to yield a skein about 55 cm. long when suspended with a weight attached. The denier of the suspended skein will, of course, be twice that of the bundle, i.e., 1500 denier. Initially, a 500 gm. weight is hung from the suspended skein. After 1 minute, length (*a*) of the skein is measured. The 500 gm, weight is then replaced with a 1.8 gm. weight to provide a tensile loading of 1.2 mg. dem., i.e., a tension in excess of that usually experienced by the yarn in a knitted sheer fabric. The skein with the weight attached is subjected to 100° C. steam at atmospheric pressure of 2 minutes, after which it is allowed to dry in air for 10 minutes. Then, skein length (*b*) is measured. Finally, the 1.8 gm. weight is replaced by the 500 gm. weight and, after a one minute delay, skein length ($c$) is measured.

Crimp eleongation (CE) is computed as $$CE(\%) = 100\frac{c-b}{b}$$

Crimp shrinkage (CS) is computed as $$CS(\%) = 100\frac{a-c}{a}$$

In the prior art, crimp elongation (CE) of a yarn has been relied upon as an indication of stretch properties to be expected in knit hose. The higher the CE, the better is the anticipated stretch. Surprisingly, the yarns of this invention generally provide low CE values, which do not predict their outstandingly improved stretch properties in hose.

4. Measuring Shape and Size of the Core.

The shape, size and eccentricity of the core (FIG. 1) in a bicomponent, sheath-core filament can be observed and measured microscopically. A straight filament is first embedded in a paraffin wax, and then 8 micron thick slices are cut normal to the filament axis using a microtome. A single slice is mounted for observation using transmitted light in an optical microscope, the sample being covered with a thin film of oil with refractive index of about 1.53. Either phase contrast or polarized light is employed to maximize optical effects due to refractive index difference between sheath and core. In the event the refractive index difference is too small for distinguishing sheath from core, the filament is very briefly immersed in a warm solution of a dark acid dye before embedding, whereby only the more readily dyeable core becomes dyed. For measurement purposes, the viewed cross section is photographed along with a suitable scale interposed in the field. When the starting filament is fully drawn, the thinnest sheath portion (covering the curved periphery of the D-shaped core 14 in FIG. 1) can be observed but has such a small radial thickness that precise measurement is difficult. The fiber producer can determine this miminum sheath thickness by collecting a filament sample as it falls freely from the spinneret, without having been drawn at all, and then measuring as above described. Filaments so collected are at least an order of magnitude larger in diameter than are the fully drawn ones. The measured thickness can then be scaled to the reduction in size imposed by drawing. It is preferred that the sheath in its thinnest arc be as thin as possible while completely covering the core. In the filaments exemplified herein, this radial thickness is about 1% of the filament diameter.

5. Hosiery Properties

Hosiery stretch (HS) and recovery (HR) are determined after suspending a leg portion of a pantyhose or hose from a clamp fastened at the welt-to-leg juncture. First, initial length ($L_o$) is meausred. A load in grams of about 140D (where D is denier of a single leg yarn) is carefully applied to the toe and, after a minute, extended length ($L_1$) is measured. Then, the load is removed suddenly and, after a minute, recovered length ($L_2$) is measured. Hosiery lengths are measured from the clamp to the heel mark (the pantyhose of Example II have no heel mark and are measured to the toe juncture).

$$HS(\%) = 100\frac{L_1 - L_o}{L_o}$$

$$HR(\%) = 100\frac{L_1 - L_2}{L_1 - L_o}$$

The higher the HS, the wider is the range of leg sizes a given hose can fit, i.e., fewer sizes of knit hose are required to fit the population of leg sizes. High values of HR indicate improved retention of fit.

Hosiery sizes are measured with a "Hifomaco"cross stretch tester (described in U.S. Pat. No. 3,444,728 to Burns, manufactured by Hickory Foundry & Machine Co., Inc., Hickory, North Carolina). In Example III only, equivalent cross-stretch measurements are made using a Jones Tester (described in U.S. Pat. No. 2,706,402 to Gaither M. Jones, Sr., manufactured by Jones Machine Co., Burlington, North Carolina). Cross-stretch as reported herein is measured on finished, unboarded hose in the upper leg about four inches (10.2 cm.) below the shadow welt and at the ankle about 2 inches (5.1 cm.) above the heel mark.

6. dtex.

The term "dtex""is an abbreviation for 37 decitex", a European term, and is obtained by multiplying denier by 10/9.

7. precrimped.

The term "precrimped" refers to yarn of one or more bicomponet filaments which has been drawn, crimped in a substantially tensionless state in a heated atmosphere and then stretched to remove the crimp before packaging.

8. as-drawn

The term "as-drawn" refers to yarn which has been drawn and packaged without precrimping.

Characterizations obtained in the test described above and other detailed information concerning test and control yarns and hose knit from such yarns are set forth in the following illustrative examples. All parts and percentages are by weight unless otherwise indicated.

EXAMPLE I

This example described a process for preparing flake of polyhexamethylene dodecandioamide (6–12) homopolymer and random copolymers comprising hexamethylene dodecanedioamide and epsilon caproamide units (6–12/6).

An aqueous solution of the salt of hexamethylene diamine and dodecandeioic acid (6–12 nylon salt) is charged to an evaporator as such (for homopolymer) or with an amount of epsilon caprolactam calculated to provide the desired copolymer ratio (for 6–12/6 copolymers). The solution is evaporated to a solids content of about 80% by weight. After transfer to an autoclave, the solution is heated to about 160° C. and brought to a pressure of 250 psig. (17.6 kg./cm.$^2$ gauge). Then, an amount of 20% by weight aqueous slurry of $TiO_2$ is added to provide 0.02% by weight $TiO_2$ in the final polymer (any customary amount of $TiO_2$ delusterant may be added, but all polymers exemplified herein contain 0.02% $TiO_2$). While maintaining constant pressure, temperature is gradually raised to about 240° C. Finally, pressure is gradually reduced to ambient atmospheric pressure while temperature continues to rise to about 250° C. for 6-12 nylon homopolymer and about 260° C. for 6-12/6 nylon copolymers. The resultant polymer is extruded under pressure of inert gas into strands which are quenched with water and then cut into 0.25 inch (0.64 cm.) flake.

EXAMPLE II

A 6-12 nylon homopolyme flake and a 6-12/6 random copolyamide with 30% by weight 6 nylon units are prepared as described in Example I. The two flakes are separately melted using vacuum exhausted screw extruders, the RV's of the melted polymers sampled just prior to entering the spinneret assembly being 36 and 42, respectively. Separate gear pumps feed the two melts at 260° ±3° C. to a spinneret assembly with flow passages of the type shown in FIG. 2 at rates adjusted to provide a 40/60 weight ratio of sheath (6-12) and core (6-12/6) polymers. The extruded filaments have cross sections of the type shown in FIG. 1.

In their departure from the spinneret, the filaments are air-quenched and then steam-conditioned before being wound up as monofilaments at 516 yd./min (472 m./min.). Quenching is in a 60 inch (1.52 meter) long chimney using cross flow air at 55° F. (12.8 C.). Steam conditioning is achieved on passage through a chamber 1.92 meters long containing saturated steam at atmospheric pressure.

The undrawn monofilament is subsequently withdrawn from its package, doubled to a 2-filament yarn and drawn over an unheated draw pin located between feed and draw rolls. The draw ratio (ratio of draw-roll to feed-roll peipheral velocities) is 4.67X and peripheral speed of the draw roll is 855 yd./min. (782 m./mon.). The drawn yarn is immediately packaged using a ring-and-traveler windup operated at a spindle speed of 7710 rpm to inert to twist of 0.254 turns per inch (0.1 turns/cm.). Denier of the resultant yarn is 23.4 (26 dtex).

A 30-denier 2-filament prior art control yarn is obtained by plying two 15-denier commerical bicomponent monofilaments. The sheath is of 6-6 nylon forming 42% by weight, and the eccentric core is of 6-6/6-10-/6-12 (50/31/5/18.5) forming the remaining 58% (6-10 identifies units of hexamethylene sebacamide). These monofilaments are prepared with precrimping substantially as described in Example VIII of U.S. Pat. No. 3,399,108 to Olson.

Properties measured for the test yarn and on ply of the control yarn are reported in Table 1.

Table 1

| | Test | 15-1 Commercial Monofilament |
|---|---|---|
| Tenacity (gm./den.) | 5.6 | 4.6 |
| (gm./dtex) | 5.0 | 4.1 |
| Elongation (%) | 22.2 | 41.2 |
| Crimp elongation (%) | 31.9 | 34.3 |
| Crimp shrinkage (%) | 16.6 | 4.1 |

Ladies' medium-size, sheer, support pantyhose are circular-knitted to the same finished size from the two 2-filament yarns. Finishing of the knit garments before wear comprises loose tumble-steaming at atmospheric pressure, conventional scouring and disperse dyeing and boarding on a medium board in a steam chest containing 220° F. (104.4° C.) saturated steam.

A panel of 20 women who normally wear sheer support hose wear the test pantyhose of this invention for 5 days. One pair fails before the end of the test, and one tester discontinues testing because of poor fit. Of the remaining18, 16 find their pantyhose fit well, and two rate their pantyhose too loose. Twelve of the 18 also rate their pantyhose as equivalent to or better than their usual support hose in terms of support provided.

A panel of 19 of the above 20 women wear the control pantyhose for 5 days. There are two early failures, and three testers discontinue testing because of poor initial fit. Four of the 14 who finish the test find their pantyhose to fit well, but 10 find they become too loose. Only five of the 14 find the support provided equal to or better than that of their usual support hose.

Hosiery stretch (HS) and hosiery recovery (HR) are measured for unworn pantyhose from the test yarn of this example (II D) and from an otherwise identical yarn (II P) which had been precrimped according to Olson. Pantyhose which had been worn for 5 days and which had been knit from the test yarn of this example (II D 5), from an otherwise identical but precrimped yarn (II P 5) and from the control yarn (II C 5) are measured similarly. In these determinations, a 3.46 Kg. load is applied at the foot-to-toe juncture. Averaged results for the two legs of each garment are reported in Table 2.

Table 2

| | HS, % | HR, % |
|---|---|---|
| II D | 240 | 93 |
| II P | 184 | 84.4 |
| II D 5 | 277 | 94.3 |
| II P 5 | 211 | 81.2 |
| II C 5 | 171 | 87.8 |

EXAMPLE III

This example illustrates the preparation of latently crimpable yarns using a continuous spinning-drawing-packaging process. The polymer flakes of Example II are used similarly to extrude filaments of the same description. Measured on melt at the point of entry to the spinneret pack, RV for the homopolymer varies from 39.3 to 38.4 during the extrusion and RV for the copolymer varies similarly from 43.3 to 42.5. The just-extruded filaments are quenched in a 60-inch (1.52 m.) long chimney using cross flow air at 21.2° C. They are simultaneously converged to 8-filament yarns, each yarn being pulled from the chimney via feed rolls at 952 yd./min. (870.5 m./min.). From the feed rolls, each yarn passes to a first draw roll operated at a peripheral velocity of 2026 yd./min (1853 M.min.) to provide a first stage draw ratio of 2.13X Thereafter each yarn sequentially contacts opposite sides of a pair of draw pins heated to 138° C. while advancing to a pair of rolls in a hot chest maintained at 120° C. Each yarn wraps this pair of rolls several times and is delivered therefrom at 3260 yards/-min. (2981 m.min.) to provide additional drawing at a 1.61X draw ratio. Total draw by both drawing steps provides a 3.42Xdraw ratio. Residence time in the hot chest is about 0.18 second. Immediately subsequent to the hot chest, each yarn wraps a let-down roll operated at a peipheral velocity of 2938 yd./min. (2686 m.min.) and then a forwarding roll operated at 3012 yd.min. (2754 m./min.) peripheral velocity. The yarns are then packaged on yarn-tubes at a yarn velocity of about 3026 yd./min. (2767 m./min.). The packaged 8-filament yarn has a total denier of 15.6 (17.3 dtex). Averaged properties for this yarn, and for a control yarn as described below are reported in Table 3.

Table 3

| | Test | Control |
|---|---|---|
| Tenacity (gm./den.) | 6.0 | 3.7 |
| (gm./dtex) | 5.4 | 3.3 |
| Elongation (%) | 30.2 | 39.8 |
| Crimp elongation (%) | 6.3 | 29.0 |
| Crimp shrinkage (%) | 11.6 | 4.4 |

The control yarn is an 18.3-denier (20.3 dtex) 8-filament yarn prepared with precrimping as described in Example VIII of Olson. It has 6-6 nylon sheath and a 6-6/6-10/6-12 (50/31.5/18.5) nylon core at a sheath-/core weight ratio and eccestricity identical to the test yarn.

Pantyhose are knit using the above yarns for the leg portions.The panty portion is of commerical 50-denier 10-filament false-twist-textured 6-6 nylon yarn. A commercial 2-feed knitting machine producing a plain jersey stitch is used, and the number of courses and stitches per course are identical. In order to provide equal finished sizes for the legs from the two yarns, it is necessary to knit the legs from the yarn of this invention with larger stitches, thus counterbalancing their higher shrinkage. The greige hose are dyed in a commerical disperse-dye, bath, the control hose at 160° F. (71.1° C.) and the test hose at 210° F. (98.9° C.) for 45 minutes. All hose are boarded on leg forms at 245° F. (118.3° C.) in a steam chest. The finished hose are of substantially equal size as indicated by measurements made on the "Jones"tester. The results are reported in Table 4.

Table 4

| | | Test | Control |
|---|---|---|---|
| Cross stretch | -ankle (in.) | 9.4 | 10.0 |
| | -knee (in.) | 14.2 | 14.6 |
| | -upper leg (in.) | 15.5 | 15.1 |

The hose from test yarns have a flatter appearance and are freer of visual defects than the control hose. A panel of twenty girls ranging in weight from 108 to 150 pounds (49 to 68 Kg. is selected to wear one pair of each type of hose for 5 days. Two of the testers find the panty portion of the test hose to be too tight to wear. One pair of the control hose fails before completion of the test. The wearers rate each hose for fit. Results are reported in Table 5

Table 5

| | Test | Control |
|---|---|---|
| Initial leg fit | | |
| too tight | 1 | — |
| slightly tight | — | 1 |
| satisfactory | 14 | 17 |
| slightly loose | 3 | 2 |
| too loose | — | — |
| 3-day leg fit | | |
| too tight | 1 | — |
| slightly tight | 1 | — |
| satisfactory | 10 | 9 |
| slightly loose | 5 | 8 |
| too loose | 1 | 3 |
| 5-day leg fit | | |
| too tight | — | — |
| slightly tight | — | — |
| satisfactory | 12 | 7 |
| slightly loose | 6 | 8 |
| too loose | — | 4 |

It is apparent that the test hose maintain their fit better than the control hose.

Crimp elongation (CE) is measured on yarns removed from unworn hose (boarded at 118.3° C. for 45 min.), from hose worn for 5 days, and from two sets of hose identical in every way to the original unworn hose except for having been boarded in steam for 1 minute at 104.4 and 110.0° C., respectively. Crimp elongation (CE) for yarn raveled from finished hose is determined by preparing a 45 meter skein having forty turns, allowing the skein to hang free for 30 seconds, hanging a 1.8 gram weight from the skein for about 5 minutes, recording its relaxed length $L_1$, hanging a 500 gram weight on the skein, recording its extended length $L_2$ and computing CE as $100(L_2-L)/L_1$. The computed values for CE are reported in Table 6.

Table 6

| | CE**, Test | CE**, Control |
|---|---|---|
| Boarded at 118.3 ° C. | 99% | 82% |
| Worn 5 days | 87% | 73% |
| Boarded at 110.0° C. | 121% | 82% |
| Boarded at 104.4° C. | 138% | 77% |

It is apparent that lower boarding temperatures than used for the wear test hose yield even better stretch and that, for yarn removed from finished hose, the test yarns are clearly improved over the control yarns. This improvement is completely unexpected in view of CE values obtained on the yarns before being knitted (Table 3).

EXAMPLE IV

A 6-12 homopolymer and four random copolymers of 6-12/6 nylon with 80/20, 70/30, 65/35, and 60/40 weight ratios are prepared as described in Example I. The RV of the homopolymer is 38.0 ± 1.5 and that of the copolymers is 43 ± 3 as measured on samples taken of each melt before it enters the spinneret pack during extrusion of filaments. The filaments are formed by extrusion as in Example II, and are structurally similar, i.e., 40% by weight 6-12 sheath, 60% by weight 6-12/6 core, and a sheath thickness along the thinnest arc of the sheath which is about 1% of the filament diameter. The filaments are quenched in a 60 inch (1.52 m.) chimney using cross flow air at 49° ± 1° F. (9.5° ± 0.5° C.). Before windup and after convergence to 3-filament yarns, the yarns pass through a 75.6 inch (1.92 m.) long chamber containing saturated steam at atmospheric pressure. Windup of the undrawn yarn into packages is at 520 yd./min. (475.5 m./min.). The yarns are subsequently withdrawn from their packages and drawn at a draw ratio of 3.933X over an unheated draw pin located between the feed and draw rolls of a conventional drawtwister. The draw roll peripheral velocity is 385 yd./min (352 m./min.), and the ring-and-traveler windup following drawing is at a spindle speed of 5689 rpm to provide 0.411 turns/inch (0.162 turns/cm.) of inserted twist.

Samples of each yarn are handled in three different ways between draw roll and windup. In the first, each drawn yarn is packaged immediately following drawing, without further heat treatment. Yarns so prepared are described as "cold-drawn only" and are identified by the code letter D (thus, D-30 identifies "cold drawn only" yarn containing 30% by weight 6 nylon units in the core).

The second and third types of handling under tension immediately after drawing involve passing the drawn yarn through a 5.8 inch (14.7 cm.) long tube through which hot air is jetted cocurrently at 0.7 ± 0.1 ft.$^3$/min. (19.8 ± 2.8 liters/min.) to provide an exit-air temperature of 115° + 2° C. At the point of air entry, the tube is 0.08 in. (0.20 cm.) in diameter, increasing gradually to 0.20 in. (0.51 cm.) at a distance of 2.8 in. (7.1 cm.). There the tube diameter increases abruptly to 0.25 in. (0.63 cm.) and remains constant for the last 3 in. (7.6 cm.) of tube length. Each yarn after exit from the tube passes in zig-zag fashion over 3 snub pins at a total contact angle of 390° + 15°. In the second type of handling the yarn is immediately packaged under tension, as above described. These heat treated yarns are identified in the tables by code letter H. In the third type of handling, each yarn after snubbing first wraps an additional roll operated at a peripheral velocity 40% less than that of the draw roll. Packaging tension is adjusted to just remove the crimp developed in the very low-tension region within and immediately following the heating. These precrimped yarns are identified by code letter P. They represent prior art processing as described by Olson. Properties of the D, H and P yarns are reported in Tables 7, 8 and 9, respectively.

A 3-filament yarn is spun substantially as described above except that the cores are 6-12/6 nylon (50/50) and the undrawn yarn is immediately drawn 3.08X before initial windup. It is found that packages of the undrawn yarn are unstable and that the yarn tends to slough off the package before it can be unwound and drawn. Drawing coupled with spinning overcomes sloughing. This yarn spins with great difficulty, has very poor along-the-end denier uniformity, and has frequent points where filaments are stuck together. It is subsequently unwound and re-drawn 1.1X to denier of about 16. Only a D-50 yarn is prepared. Re-drawing is also difficult, but enough knittable yarn to knit a few hose can be selected.

Table 7

| | D-20 | D-30 | D-35 | D-40 |
|---|---|---|---|---|
| Denier (dtex) | 15.5 (17.2) | 15.6 (17.3) | 15.7 (17.4) | 15.8 (17.6) |
| Tenacity (gm./den.) | 5.7 | 5.3 | 4.6 | 4.7 |
| Elongation (%) | 36.3 | 28.3 | 26.9 | 31.0 |
| Crimp elongation (%) | 3.4 | 13.0 | 23.6 | 38.9 |
| Crimp shrinkage (%) | 15.3 | 16.6 | 15.4 | 16.0 |

Table 8

| | H-20 | H-30 | H-35 | H-40 |
|---|---|---|---|---|
| Denier (dtex) | 17.3 (19.2) | 17.6 (19.6) | 18.5 (20.6) | 18.3 (20.3) |
| Tenacity (gm./den.) | 5.1 | 4.6 | 3.7 | 3.3 |
| Elongation (%) | 51.3 | 49.4 | 47.7 | 49.4 |
| Crimp elongation (%) | 3.9 | 16.0 | 23.7 | 23.0 |
| Crimp shrinkage (%) | 6.8 | 6.8 | 6.1 | 6.5 |

Table 9

| | P-20 | P-30 | P-35 | P-40 |
|---|---|---|---|---|
| Denier (dtex) | ** | 20.0(22.2) | 20.0(22.2) | 19.6(21.8) |
| Tenacity (gm./den.) | ** | 3.4 | 2.9 | 2.4 |
| Elongation (%) | ** | 55.4 | 52.1 | 43.6 |
| Crimp elongation (%) | ** | 47.5 | 38.9 | 35.0 |
| Crimp shrinkage (%) | ** | 4.5 | 5.7 | 6.2 |

**was inoperable during precrimping due to insufficient shrinkage

Both heat treating and precrimping desirably decrease crimp shrinkage, but they also diminish tenacity somewhat.

Ladies' stretch hose are knitted with a plain jersey stitch using a single-feed circular knitting machine with 400 75-gauge knitting needles arranged in a circle about a cylinder which is 3.75 in. (9.52 cm.) in diameter. The welt and shadow welt are immaterial to the stretch and recovery tests to be performed, but they are knitted with 432 and 60 courses, respectively. The upper leg is knitted with 672 courses, tapering begins during the next 12 courses, and the lower leg comprises 516 courses. Then, the foot is knitted with 372 courses in the first of which a second yarn is inserted for a few stitches to serve as a heel mark.

After knitting, the greige hose (packed loosely in bags at 12 per bag) are first tumble-steamed in atmospheric steam for 15 minutes, then scoured conventionally at 99° C. for 15 minutes, then rinsed in three 5-minute water rinses, and then spun dry in the spin cycle of a home laundering machine. The bags are made by doubling cheese cloth (U.S.P. 11 or equivalent) and permanently closing three sides. When empty and flat, each bag is about 18 × 16 inches (45.7 × 40.6 cm.). The filled bags are tied shut at the fourth side. Still in bags, the hose are dyed in a conventional disperse dye bath at 60° C. for 1 hour and 15 minutes. After several short washings to remove excess dye solution, the hose are again spun dry. Drying is completed at room temperature with each hose carefully laid flat on a table top.

Hosiery stretch (HS) and hosiery recovery (HR) are measured. In this determination, the applied load is a 2.27 kg. weight which is fastened to the toe and slowly lowered until the hose supports it without tensile shock. Five to eight measurements are averaged to provide the hosiery stretch, hosiery recovery and cross stretch results reported in Table 10 (except for D-50, for which only a few hose are available).

For comparison, hose are knitted and finished identically using commercial 20-denier three bicomponent-filament nylon hosiery yarn. Stretch and recovery values for a range of sizes are reported in Table 11.

It is apparent that measured hosiery stretch is a function of size (cross stretch). The increases in hosiery stretch for hose from yarns of this invention over hose of commercial control yarns are, however, much larger than can be accounted for just by the minor size differences.

For purposes of comparison with the hosiery properties reported in Table 10, more filaments from polymers disclosed by Olson are prepared. The yarns are 18-denier, 8 filaments, and each filament has 40% by weight sheath polymer and 60% by weight copolymer in an eccentric core. The sheath polymer is polyhexamethylene adipamide (6—6) and the core polymer is a random copolymer of 50% by weight 6—6 units, 31.5% by weight hexamethylene sebacamide (6-10) units and 18.5% by weight hexamethylene dodecanedioamide (6-12) units. Relative viscosity (RV) for these polymers is measured on samples taken of the melt at a point just prior to entry into the spinning pack. The equipment and general procedures of Example III are used to prepare cold-drawn only, heat-treated and precrimped yarns as described above. Process conditions for preparing these three products are reported in Table 12.

Table 13 shows CE* and CS* results for these yarns. Prior to this work, crimp elongation (CE) and crimp shrinkage (CS) had always been measured using the tests as described under "Definitions and Test Descriptions". It is to be noted that the CE values for yarns of this invention are much lower than previously obtained using precrimped bicomponent stretch yarns but that, in spite of low CE, the yarns of this invention yield hose of vastly superior stretch properties. In an attempt to obtain crimp elongation values correlating better with hosiery stretch properties, a substitute test was devised.

In the substitute test, a skein of yarn is formed from an integral number ($n$) of loops such that total skein denier ($2n$D, where D is denier of the yarn) is as close as possible to 2084. The suspended skein is 0.563 m. long. Length $L_0$ is measured and recorded for the skein suspended in air under a load of 695 gm. The heavy load is removed leaving only its aluminum support weighing 2.5 gm. The skein and attached support are suspended in water at 95° C. for 1 minute for crimp development. Due to water buoyancy, the support actually exerts only about 0.75 mg./den. of force on the skein during crimp development. Removed from the water, the skein dries in ambient air. Length $L_1$ is then measured and recorded, the full 695 gm. load is reapplied, and extended length $L_2$ is measured and recorded. CE* and CS* (the asterisk denoting this revised method) are computed as:

$$CE^* (\%) = 100\,(L_2 - L_1)/L_1$$

$$CS^* (\%) = 100\,(L_0 - L_2)/L_0$$

The CE* values of Table 13 for prior art bicomponent yarns are generally as great as the corresponding CE values of Table 7–9 for yarns of this invention, but the HS values of Table 13 are generally much smaller than found in Table 10 for yarns of this invention. While the reasons are not completely understood, experience has shown that CE* is not only a better predictor of ultimate hosiery stretch than CE, but also it is a far more reproducible property value.

Table 10

| Yarn Code | Hosiery Cross Stretch Leg (cm.) | Hosiery Cross Stretch Ankle (in./cm.) | Hosiery Stretch(%) | Hosiery Recovery(%) |
|---|---|---|---|---|
| D-20 | 13.3/34 | 9.8/25 | 184 | 79.7 |
| D-30 | 12.7/32 | 9.3/24 | 271 | 83.9 |
| D-35 | 13.0/33 | 9.7/25 | 294 | 85.6 |
| D-40 | 13.0/33 | 9.7/25 | 314 | 91.0 |
| D-50 | — | — | ~200 | ~72 |
| H-20 | 14.9/38 | 11.0/28 | 165 | 77.4 |
| H-30 | 14.4/36 | 11.0/28 | 273 | 83.5 |
| H-35 | 14.3/36 | 11.0/28 | 306 | 84.8 |
| H-40 | 14.5/37 | 10.5/27 | 298 | 88.4 |
| P-20 | — | — | — | — |
| P-30 | 14.1/36 | 10.9/28 | 236 | 65.8 |
| P-35 | 13.7/35 | 10.5/27 | 228 | 65.4 |
| P-40 | 14.7/37 | 10.6/27 | 222 | 73.0 |

Table 11

| Hosiery Cross Stretch Leg (in./cm.) | Hosiery Cross Stretch Ankle (in./cm.) | Hosiery Stretch(%) | Hosiery Recovery(%) |
|---|---|---|---|
| 14.1/36 | 10.9/28 | 171 | 81.8 |
| 13.4/34 | 10.0/25 | 150 | 81.2 |
| 13.0/33 | — | 144 | 82.0 |
| 12.8/32 | 9.5/24 | 143 | 82.0 |

Table 12

| | Cold-draw only | Heat-Treated | Pre-crimped |
|---|---|---|---|
| RV (sheath) | 49.5 | 49.5 | 50 |
| RV (core) | 63 | 63 | 63 |
| Chimney air temp. (° C.) | 21.1 | 21.1 | 21.1 |
| Feed-roll speed (ypm.) | 950 | 950 | 930 |
| (m./min.) | (869 | (869) | (850) |
| 1st Draw-roll speed (ypm.) | 1878 | 1878 | 2457 |
| Draw pin temp. (° C.) | 200 | 200 | 200 |
| Hot-chest roll speed (ypm.) | 2846 | 2846 | 3150 |
| (m./min.) | (2602) | (2602) | (2880) |
| Hot-chest roll temp. (° C.) | off (RT) | 150 | 145 |
| Precrimping jet | | | |
| supply pressure (psig.) | none | none | 29 |
| (kg./cm²) | | | (2.04) |
| supply temp. (° C.) | none | none | 186 |
| Let-down roll speed (ypm.) | 2769 | 2794 | 2396 |
| (m./min.) | (2532) | (2555) | (2191) |
| Forwarding roll speed (ypm.) | 2783 | 2812 | 2749 |
| (m./min.) | (2545) | (2571) | (2514) |
| Windup roll speed (ypm.) | 2797 | 2824 | 2736 |
| (m./min.) | (2558) | (2582) | (2502) |

Table 13

| | Cold-draw only | Heat-Treated | Precrimped |
|---|---|---|---|
| Denier (dtex) | 19.9 (22.1) | 19.1 (21.2) | 18.3 (20.3) |
| Tenacity (gm./den.) | 3.9 | 4.4 | 3.3 |
| (gm./dtex) | (3.5) | (4.0) | (3.0) |
| Elongation (%) | 32.0 | 26.1 | 36.0 |
| CE* (%) | 76.8 | 23.9 | 41.5 |
| CS* (%) | 13.7 | 10.0 | 3.9 |
| Finished leg cross-stretch, in. | 12.83 | 13.11 | 13.81 |
| (cm.) | (32.6) | (33.3) | (35.1) |
| HS (%) | 141 | 85 | 169 |
| HR (%) | 81.3 | 76.9 | 77.5 |

EXAMPLE V

This example shows the effect of a different homopolyamide sheath, 6—6 nylon, on yarns and hosiery which otherwise are as described in Example IV. At the same time, additional 6–12//6–12/6 bicomponent-filament yarns are prepared in the same manner. When two yarns of identical composition are shown in Tables 14–17, it means that they are identically prepared on separate days.

The polyhexamethylene adipamide (6—6 nylon) employed in forming the 6—6//6–12/6 filaments has an RV of 51.4 ± 4.2 and is spun at a melt temperature of about 290° C. The filaments containing 6–12/6 (50/50) cores are processed just like the others rather than as separately described in Example IV. Test methods are identical to those of Example IV.

In Tables 14 and 16, the listed properties are averages of 6 to 8 determinations. In Tables 15 and 17, the hosiery properties are averages for 4 hose, each knitted from a separate package of the indicated yarn type. The "cut-of-hose" properties are measured on yarn removed from hose after measurement of HS and HR.

The filaments with 6–12/6 (50/50) cores (outside this invention), although improved over the corresponding ones of Example IV, are difficult to prepare and nonuniform in denier. Interfilament sticking is frequent. Hose prepared using these filaments have surprisingly high HS values, which is not predicted by the CE values of the corresponding yarns. Tables 14 and 16 confirm that CE* is a much more reliable indicator of ultimate hosiery stretch than is CE. Statistical study of the breaking strengths of yarn out-of-hose (Tables 15 and 17) reveals that breaking strength of each yarn decreases substantially linearly with increasing weight percent of 6 nylon in the core of each filament. Above about 45% 6 nylon in the core, the yarns become too weak for adequate durability in use.

Use of 6—6 nylon as sheath polymer, rather than 6-12 nylon, yields slightly lower hosiery stretch and hosiery recovery values, but the diminishment is slight when compared to stretch properties attainable heretofore with known bicomponent-filament hosiery yarns. In both cases, the dependence of hosiery stretch on percent 6 nylon in the core is substantially the same. Below 25% 6 nylon in the core, stretch properties become inadequate. Above 45% 6 nylon in the core, the yarns become not only difficult to handle in spinning but also inadequate in breaking strength.

Table 14

| | | 6-6//6-12/6 Nylon Yarn Characterizations (Before Knitting) | | | | | | |
|---|---|---|---|---|---|---|---|---|
| | | Tenacity | Elongation | Tenacity | atmospheric steam | | 95° C. Water | |
| Yarn | Denier | T(gm/den) | E(%) | $T_B$(gm/den) | CE(%) | CS(%) | CE*(%) | CS*(%) |
| D-20 | 16.8 | 4.6 | 27.9 | 5.8 | 3.9 | 13.1 | 32.4 | 14.3 |
| D-25 | 16.3 | 4.4 | 22.1 | 5.3 | 19.6 | 12.1 | 61.7 | 11.3 |
| D-30 | 16.5 | 4.5 | 29.5 | 5.8 | 6.1 | 13.6 | 79.5 | 16.1 |
| D-30 | 16.1 | 4.3 | 22.4 | 5.3 | 12.5 | 12.3 | 100.7 | 14.8 |
| D-35 | 16.4 | 4.4 | 29.2 | 5.6 | 10.0 | 14.3 | 131.6 | 17.5 |
| D-35 | 16.2 | 4.0 | 21.4 | 4.9 | 13.0 | 12.8 | 101.0 | 14.9 |
| D-40 | 16.5 | 4.0 | 25.5 | 5.0 | 18.9 | 14.1 | 149.8 | 18.1 |
| D-45 | 16.4 | 3.8 | 25.1 | 4.8 | 27.7 | 13.1 | 124.3 | 13.2 |
| D-50 | 16.5 | 3.6 | 22.3 | 4.4 | 6.2 | 12.9 | 56.7 | 14.0 |
| H-20 | 17.2 | 4.5 | 36.0 | 6.1 | 4.0 | 8.8 | 24.4 | 8.8 |
| H-25 | 17.4 | 4.1 | 32.3 | 5.4 | 6.4 | 8.3 | 39.6 | 10.0 |
| H-30 | 17.4 | 4.0 | 32.2 | 5.3 | 5.7 | 9.3 | 54.8 | 9.8 |
| H-30 | 17.1 | 4.0 | 30.0 | 5.2 | 7.7 | 8.7 | 64.5 | 11.9 |
| H-35 | 17.5 | 4.0 | 35.3 | 5.4 | 7.0 | 10.3 | 77.7 | 11.1 |
| H-35 | 17.1 | 3.9 | 28.1 | 5.0 | 7.9 | 8.6 | 76.9 | 11.9 |
| H-40 | 17.4 | 3.7 | 32.8 | 4.9 | 7.5 | 10.0 | 91.8 | 10.6 |
| H-45 | 17.3 | 3.5 | 29.2 | 4.5 | 11.9 | 9.0 | 100.1 | 12.0 |
| H-50 | 17.0 | 3.3 | 28.2 | 4.2 | 9.1 | 8.0 | 41.0 | 9.0 |

Table 15

| | 6-6//6-12/6 Nylon Hosiery Characterizations | | | | | |
|---|---|---|---|---|---|---|
| | Hosiery Size Cross-stretch-in. (cm.) | | Hosiery Stretch | | Yarn Out of Hose | |
| Yarn | Leg | Ankle | HS(%) | HR(%) | Breaking Strength (gm) | Elongation (%) |
| D-20 | 14.97(38.0) | 11.47(29.1) | 123.1 | 75.2 | 71.0 | 38.2 |
| D-25 | 14.62(37.1) | 11.25(28.6) | 202.8 | 77.3 | 66.0 | 35.1 |
| D-30 | 14.72(37.4) | 11.16(28.3) | 279.4 | 80.1 | 67.3 | 44.9 |
| D-30 | 14.56(37.0) | 11.03(28.0) | 263.3 | 78.4 | 60.5 | 42.4 |
| D-35 | 14.47(36.8) | 11.22(28.5) | 315.5 | 81.2 | 60.1 | 38.6 |
| D-35 | 14.37(36.5) | 10.94(27.8) | 298.2 | 80.8 | 59.6 | 41.5 |
| D-40 | 14.44(36.7) | 11.28(28.7) | 337.3 | 83.0 | 55.0 | 44.9 |
| D-45 | 14.28(36.3) | 10.87(27.6) | 349.9 | 77.7 | 49.3 | 46.3 |
| D-50 | 14.81(37.6) | 11.19(28.4) | 338.9 | 79.8 | 45.1 | 42.1 |
| H-20 | 14.87(37.8) | 10.59(26.9) | 120.4 | 75.7 | 71.4 | 41.6 |
| H-25 | 14.42(36.6) | 10.33(26.2) | 186.5 | 76.4 | 70.0 | 45.3 |
| H-30 | 14.62(37.1) | 10.47(26.6) | 268.3 | 79.6 | 64.0 | 41.3 |
| H-30 | 14.19(36.0) | 10.15(25.8) | 237.5 | 78.0 | 64.6 | 43.3 |
| H-35 | 14.66(37.2) | 10.72(27.2) | 307.7 | 81.9 | 58.6 | 34.7 |
| H-35 | 14.75(37.5) | 10.59(26.9) | 285.2 | 81.2 | 61.6 | 41.3 |
| H-40 | 14.53(36.9) | 10.56(26.8) | 302.3 | 82.5 | 56.9 | 44.0 |
| H-45 | 14.06(35.7) | 10.12(25.7) | 354.1 | 79.9 | 51.8 | 46.3 |
| H-50 | 14.31(36.3) | 10.31(26.2) | 332.4 | 81.7 | 46.9 | 40.4 |

Table 16

| | | 6-12/6-12/6 Nylon Yarn Characterizations (Before Knitting) | | | | | | |
|---|---|---|---|---|---|---|---|---|
| | | Tenacity | Elongation | Tenacity | Atmospheric steam | | 95° C. Water | |
| Yarn | Denier | T(gm/den) | E(%) | $T_B$(gm/den) | CE(%) | CS(%) | CE*(%) | CS*(%) |
| D-25 | 15.9 | 4.8 | 29.9 | 6.2 | 18.8 | 13.8 | 97.9 | 15.6 |
| D-30 | 15.8 | 5.2 | 32.8 | 6.9 | 8.8 | 15.6 | 96.4 | 18.6 |
| D-30 | 15.6 | 5.0 | 29.4 | 6.4 | 6.3 | 14.9 | 96.3 | 18.0 |
| D-35 | 15.9 | 4.5 | 30.0 | 5.8 | 6.3 | 15.2 | 143.2 | 19.9 |
| D-40 | 16.1 | 4.4 | 29.2 | 5.6 | 9.4 | 15.4 | 184.5 | 21.2 |
| D-45 | 15.7 | 4.1 | 30.8 | 5.3 | 39.2 | 15.3 | 186.3 | 18.0 |
| D-50 | 16.0 | 3.9 | 31.5 | 5.1 | 4.6 | 15.1 | 74.0 | 18.2 |
| H-25 | 17.8 | 4.4 | 47.0 | 6.4 | 12.8 | 8.2 | 49.8 | 7.6 |
| H-30 | 17.4 | 4.4 | 48.3 | 6.5 | 11.2 | 6.9 | 48.7 | 7.2 |
| H-30 | 17.6 | 4.2 | 43.1 | 6.0 | 8.4 | 8.5 | 45.8 | 8.0 |
| H-35 | 17.5 | 4.0 | 43.8 | 5.7 | 6.5 | 8.5 | 76.6 | 10.1 |
| H-40 | 17.7 | 3.6 | 44.2 | 5.1 | 10.0 | 7.9 | 39.4 | 7.3 |
| H-45 | 17.6 | 3.2 | 42.0 | 4.5 | 7.9 | 10.0 | 71.1 | 9.8 |
| H-50 | 17.7 | 2.9 | 42.5 | 4.1 | 21.2 | 7.2 | 73.9 | 8.7 |

Table 17

| | 6-12//6-12/6 Nylon Hosiery Characterizations | | | | | |
|---|---|---|---|---|---|---|
| | Hosiery Size Cross-stretch-in(cm.) | | Hosiery Stretch | | Yarn Out of Hose | |
| Yarn | Leg | Ankle | HS(%) | HR(%) | Breaking Strength(gm.) | Elongation(%) |
| D-25 | 13.69(34.8) | 10.50(26.7) | 253.5 | 83.6 | 72.8 | 56.0 |
| D-30 | 13.96(35.5) | 10.67(27.1) | 302.1 | 85.2 | 70.3 | 53.6 |

Table 17-continued

| 6-12//6-12/6 Nylon Hosiery Characterizations | | | | | | |
|---|---|---|---|---|---|---|
| | Hosiery Size Cross-stretch-in(cm.) | | Hosiery Stretch | | Yarn Out of Hose | |
| Yarn | Leg | Ankle | HS(%) | HR(%) | Breaking Strength(gm.) | Elongation(%) |
| D-30 | 13.75(34.9) | 10.50(26.7) | 284.3 | 83.4 | 62.8 | 39.8 |
| D-35 | 13.65(34.7) | 10.47(26.6) | 301.3 | 81.9 | 59.0 | 48.2 |
| D-40 | 13.47(34.2) | 10.25(26.0) | 329.0 | 81.4 | 57.8 | 51.5 |
| D-45 | 13.59(34.5) | 10.28(26.1) | 343.4 | 76.8 | 41.5 | 46.0 |
| D-50 | 14.12(35.9) | 10.62(27.0) | 343.2 | 77.5 | 37.3 | 39.3 |
| H-25 | 14.72(37.4) | 10.72(27.2) | 222.4 | 83.9 | 66.0 | 54.7 |
| H-30 | 14.91(37.9) | 10.96(27.8) | 297.7 | 84.3 | 64.6 | 55.8 |
| H-30 | 14.47(36.8) | 10.62(27.0) | 286.0 | 85.2 | 66.0 | 46.9 |
| H-35 | 14.56(37.0) | 10.66(27.1) | 317.9 | 86.2 | 57.8 | 48.4 |
| H-40 | 14.19(36.0) | 10.41(26.4) | 325.3 | 85.5 | 55.4 | 51.3 |
| H-45 | 14.19(36.0) | 10.25(26.0) | 340.4 | 84.6 | 45.0 | 42.9 |
| H-50 | 14.46(36.7) | 10.67(27.1) | 288.7 | 84.7 | — | — |

EXAMPLE VI

This example shows the effect of varying sheath/core weight ratio. The sample identified as D-30 in Example IV has a 6-12 sheath and a 6-12/6 core with 30% by weight 6 units. Samples J and K are prepared as described for D-30 in Example IV except for sheath/core weight ratio. Sheath/core weight ratio is varied by adjusting the flow rates of the two melts into the spinneret assembly. Yarn properties are reported in Table 18.

Table 18

| | D-30 | J | K |
|---|---|---|---|
| sheath/core wgt. ratio | 40/60 | 45/55 | 35/65 |
| Tenacity (gm./den.) | 5.3 | 5.4 | 5.3 |
| (gm./dtex) | 4.8 | 4.9 | 4.8 |
| Elongation (%) | 28.3 | 30.5 | 28.9 |
| CE (%) | 13.0 | 12.4 | 11.7 |
| CS (%) | 16.6 | 15.5 | 17.4 |
| Denier | 15.6 | 15.6 | 15.5 |
| dtex | 17.3 | 17.3 | 17.2 |

Within the range investigated, sheath/core weight ratios have little effect on yarn properties. For hosiery filaments with the sheath at its thinnest point being about 1% of the filament diameter, maximum crimp frequency is obtained when the filament comprises about 50-60 percent by weight core polymer. Crimp frequency is not strongly dependent on percentage of core. Except at the lower extreme of the operable level for percentage of 6 nylon units in the core, filaments with 30-70% by weight core polymer can provide useful levels of crimp.

EXAMPLE VII

This example follows essentially the preparative methods and uses the same apparatus as Example II to compare 6//6-12/6 nylon yarns and hose with equivalently prepared 6-12//6-12/6 and 6—6//6-12/6 nylon yarns and hose. The RV's of the polymers, measured as in Example II, are:

| | |
|---|---|
| 6-12/6 | 43 ± 1.5 (65/35 weight ratio) |
| 6-12 | 38.5 ± 0.5 |
| 6 | 40.6 |
| 6-6 | 51.4 ± 2.4 |

Melt temperatures are 260° ± 3° C. for spinning fibers with 6-12 or 6 sheaths and 287° ± 3° C. for those with 6—6 sheaths. Meter pumps are adjusted to provide 60% by volume of core polymer in each filament which, by calculation, yields 58.7-59.0% by weight of core polymer (i.e., close to a 40/60 sheath/core weight ratio.). Monofilaments are spun, quenched, and steam conditioned, being plied to 2-filament yarns just before windup of the undrawn yarns at 500 yd./min. (457.2 m./min.). Cross-flow quenching air is supplied at 49° ± 1° F. (9.4° ± 0.5° C.).

The spun 2-filament yarns are subsequently drawn using an unheated draw pin located between feed and draw rolls. Draw ratio is 4.225X at a draw-roll speed of 590 yd./min. The drawn yarns are immediately packaged using a ring-and-traveler windup which inserts 0.335 turns of twist per inch (0.132 turns/cm.). Yarn properties obtained are shown in Table 19.

Hosiery are knitted and tested as described in Example IV except that the load applied for HS and HR determinations is 2.77 kg. rather than 2.27 kg. The drawn-only yarns of Example IV are nominally 16-denier, whereas the yarns of this example are nominally 20-denier. the adjustment in load is proportional to the difference in yarn denier. Characterizations of the hose are presented in Table 20.

Except for the out-of-hose measured properties of Table 20, all recorded measurements are averages of samples from twelve yarn packages for the 6 nylon sheath species and from six yarn packages for the 6—6 and 6-12 nylon sheath species. Out-of-hose properties are measured for four hose of the 6 nylon sheath yarns and for two hose each of the yarns with 6—6 and 6-12 nylon sheaths.

It is apparent from Table 20 that, although the hose of yarns with 6-12 nylon sheaths are superior, all three species provide excellent stretch properties.

TABLE 19

| Filament | Yarn | Tenacity (T) | Elongation | Break Tenacity ($T_B$) | 95° C. Water | | Atmospheric steam | |
|---|---|---|---|---|---|---|---|---|
| Type | Denier | (gm./den.) | % | (gm./den.) | CE* | CS* | CE | CS |
| 6-12//6-12/6 | 21.5 | 4.8 | 32.2 | 6.3 | 194.6 | 21.3 | 59.2 | 17.9 |
| 6-6//6-12/6 | 22.2 | 4.3 | 28.1 | 5.5 | 143.8 | 16.3 | 39.1 | 15.4 |
| 6//6-12/6 | 22.2 | 5.4 | 19.7 | 6.5 | 147.6 | 21.3 | 43.7 | 19.8 |

TABLE 20

| Filament Type | Hosiery Size Cross-stretch; in. (cm.) Leg | Ankle | Hosiery Stretch HS(%) | HR(%) | Yarn Out of Hose Breaking Strength (gm.) | Elongation (%) |
|---|---|---|---|---|---|---|
| 6-12//6-12/6 | 13.27(33.7) | 10.27(26.1) | 315.3 | 84.8 | 80.1 | 56.0 |
| 6-6//-12/6 | 13.64(34.6) | 10.77(27.4) | 282.9 | 78.6 | 79.7 | 46.3 |
| 6//6-12/6 | 12.72(32.3) | 9.88(25.1) | 263.0 | 77.0 | 104.1 | 46.9 |

What is claimed is:

1. A fabric comprising yarn of non-precrimped nylon filament consisting essentially of two, continuous, adherent, eccentric components, one component being a sheath consisting essentially of a homopolymer selected from the group consisting essentially of polyhexamethylene dodecanedioamide, polyhexamethylene adipamide, and poly-ϵ-caproamide, the other component being a core consisting essentially of a random copolymer of hexamethylene dodecanediomamide and ϵ-caproamide units, said copolymer consisting about 25–45% by weight of ϵ-caproamide units, said yarn being made into said fabric without precrimping and is thereafter crimped.

2. The fabric of claim 1 wherein said fabric is at least the leg portion of hosiery.

3. The fabric of claim 1 wherein said yarn is made into said fabric by knitting.

4. A crimpable non-precrimped nylon filament consisting essentially of two, continuous, adherent, eccentric components, one component being a sheath consisting essentially of polyhexamethylene dodecanedioamide and the other component being a core consisting essentially of a random copolymer of hexamethylene dodecanedioamide and ϵ-caproamide units, said copolymer containing about 25–45% by weight of ϵ-caproamide units.

5. A crimpable non-precrimped nylon filament suitable for yarn for making into fabric without precrimping and for being crimped thereafter, said filament consisting essentially of two, continuous, adherent eccentric components, one component being a sheath consisting essentially of a homopolymer selected from the group consisting of polyhexamethylene dodecanedioamide, polyhexamethylene adipamide and, poly-ϵ-caproamide, the other component being a core consisting essentially of a random compolymer of hexamethylene dodecanedioamide and ϵ-caproamide units, said copolymer containing about 25–45% by weight of ϵ-caproamide units.

6. The filament of claim 5, said copolymer containing about 35% by weight of ϵ-caproamide units.

7. A fabric from yarn comprised of at least one filament as defined in claim 5.

8. The filament of claim 5, wherein said sheath consists essentially of polyhexamethylene adipamide.

9. The filament of claim 5, wherein said sheath consists essentially of poly-ϵ-caproamide.

10. The filament of claim 5, wherein said core is 30–70% by weight of the filament.

11. Staple fibers cut from the filament of claim 5.

12. The filament of claim 5 wherein the amount of said ϵ-caproamide units present is up to 40% by weight.

* * * * *